United States Patent [19]

Laycock et al.

[11] Patent Number: 4,636,249

[45] Date of Patent: Jan. 13, 1987

[54] TREATMENT OF MOLTEN METAL

[75] Inventors: Arthur Laycock, Doncaster; Michael J. Harris, Rotherham; Mark A. Broxholme, Sheffield, all of England

[73] Assignee: British Steel Corporation, London, England

[21] Appl. No.: 811,994

[22] Filed: Dec. 23, 1985

[30] Foreign Application Priority Data

Dec. 28, 1984 [GB] United Kingdom ..... 8432748
Jan. 9, 1985 [GB] United Kingdom ..... 8500535

[51] Int. Cl.[4] ..... C21C 7/02

[52] U.S. Cl. ..... 75/53; 75/49; 75/58

[58] Field of Search ..... 75/53, 58, 49, 129

[56] References Cited

U.S. PATENT DOCUMENTS 3,201,226 8/1965 Spolders ..... 75/59.31
3,484,232 12/1969 Karinthi ..... 75/59.1
3,547,622 12/1970 Hutchinson ..... 75/49
3,841,867 10/1974 Davies et al. ..... 75/129
3,869,283 3/1975 Davies et al. ..... 75/129

FOREIGN PATENT DOCUMENTS 1487925 10/1977 United Kingdom .

*Primary Examiner*—Peter D. Rosenberg
*Attorney, Agent, or Firm*—Kinney & Lange

[57] ABSTRACT

The invention is directed to a method of and apparatus for, introducing into a bath of molten metal (e.g. ferrous metal) contained in a vessel an alloying component (e.g. lead) or a reagent. The method includes the steps of connecting a plurality of plugs or nozzles located in the bottom and/or sides of the vessel to supplies of gas (e.g. argon) under pressure, and causing gas to be introduced simultaneously through the plugs or nozzles to produce individual gas flows which pass upwardly through the metal bath to create areas of turbulence on the bath surface. The areas of turbulence interact to produce on the bath surface a relatively quiescent region and it is into this relatively quiescent region that the required quantity of alloying component or reagent is added.

7 Claims, 2 Drawing Figures

TREATMENT OF MOLTEN METAL

BACKGROUND OF THE INVENTION

1. Field of the Invention

This invention relates to a method of and apparatus for treating molten metal in which an addition of an alloying material or a reagent is made to a bath of the molten metal.

2. Description of the Prior Art

In the steel industry such additions are made, for example, to impart machinability-improving characteristics to a steel or to desulphurise a steel melt. An alloying addition frequently practised in the steel industry is that of lead. Examples of this practice can be found in our United Kingdom patent specification Nos. 1,322,711, 1,322,712 and 1,487,925. Two of these specifications are directed to a twin ladle practice and the other relates to a single ladle technique incorporating inert gas bubbling for stirring the melt and ensuring adequate dispersion and uniform distribution of the lead within the melt. The present invention is particularly directed towards improving this latter technique.

SUMMARY OF THE INVENTION

According to the present invention in one aspect, there is provided a method of introducing into a bath of molten metal contained in a vessel, an alloying component or a reagent, which method comprises the steps of connecting a plurality of plugs or nozzles located in the bottom and/or sides of the vessel to supplies of gas under pressure, causing gas under pressure to be introduced simultaneously through the plugs or nozzles to produce individual gas flows which pass upwardly through the metal bath to create areas of turbulence, the boundaries of which interact partially to produce on the surface of the metal bath a relatively quiescent region, and introducing into this relatively quiescent region on the surface of the molten metal, the required quantity of alloying component or reagent.

From another aspect, the present invention provides a method of introducing into a bath of molten metal contained in a vessel an alloying component or a reagent in which the addition is made into a relatively quiescent region created on the surface of the metal bath by the interaction of areas of turbulence caused by upward flows through the molten metal of gas introduced into the vessel through a plurality of spaced plugs or nozzles located in the bottom and/or sides of the vessel.

From a further aspect the invention provides apparatus for treating molten metal comprising a vessel, a plurality of spaced plugs or nozzles located in the bottom and/or sides of the vessel, means for connecting each such plug or nozzle to a supply of gas under pressure, means for injecting gas simultaneously through each said plug or nozzle and means for introducing into the top of the vessel an alloying component or a reagent, the spacing between the plugs or nozzles being such that in use of the apparatus, areas of surface turbulence caused by the upward passage of gas injected through the plugs or nozzles interact to create on the surface of molten metal contained in the vessel, a relatively quiescent zone into which the alloying component or reagent is introduced.

The plugs or nozzles may be manufactured from a porous material or may include discrete apertures or orifices.

In one arrangement two plugs are provided, both plugs being sited in the base of the vessel adjacent the vessel wall so that the relatively quiescent region is created within the overlapping interface of the turbulent zones caused by the gas injected from the two plugs, and the wall of the vessel adjacent these zones. Alternatively, gas may be injected through refractory nozzles located within a slide gate mechanism.

The molten metal may comprise a ferrous melt (for example a steel melt) and the alloying component may be lead, preferably in particulate form. The addition may be pressure injected onto the surface of the melt or fed from above under gravity. Alternatively, the added particles may be encapsulated in a consumable sheath or may take the form of a wire or strip.

The molten metal may initially, be heated to a temperature in excess of that normally adopted when tapping molten metal from a furnace into a holding vessel, such as a ladle, to promote solubility of the addition and to ensure that, during the period required for the treatment to be completed, the temperature of the molten metal does not fall below that which is desirable for teeming or casting purposes. Whereas the gas, e.g. argon, is injected through the plugs or nozzles simultaneously, the gas lines connected to the plugs or nozzles are preferably independently controllable in order to adjust and govern the relatively quiescent zone. The term 'relatively quiescent' region or zone is to be interpreted from a practical standpoint and is to be taken to mean a region or zone present on the surface of a bath of molten metal in which there is a substantially reduced amount of agitation when compared with areas of greater agitation caused by the upflow of gas introduced into the vessel at locations below the metal surface. Additions made to a relatively quiescent region or zone are not immediately drawn downwardly into the bulk of the molten metal contained in the vessel, thereby increasing the residence time of the additions on the melt surface and enabling greater dissolution to take place before such additions are drawn below the metal surface into the bulk of the metal.

Where the particulate addition is gravity fed, this may be effected from a hopper via spreaders in the form of one or more chutes.

In use of the invention, it has been found that gross segregation of lead is avoided and that an improved and more consistent distribution is achieved. Furthermore, a greater degree of lead recovery, in excess of 70% is achieved. Likewise, the analysis of the melt can more readily be controlled.

In order that the invention may be more fully understood, one embodiment thereof will now be described, by way of example, with reference to the accompanying drawings, in which:

FIG. 1 is a schematic side elevational view in section of treatment apparatus in accordance with the invention; and FIG. 2 is a plan view taken along lines II—II of FIG. 1.

DETAILED DESCRIPTION OF THE PREFERRED EMBODIMENT

Figure 1:
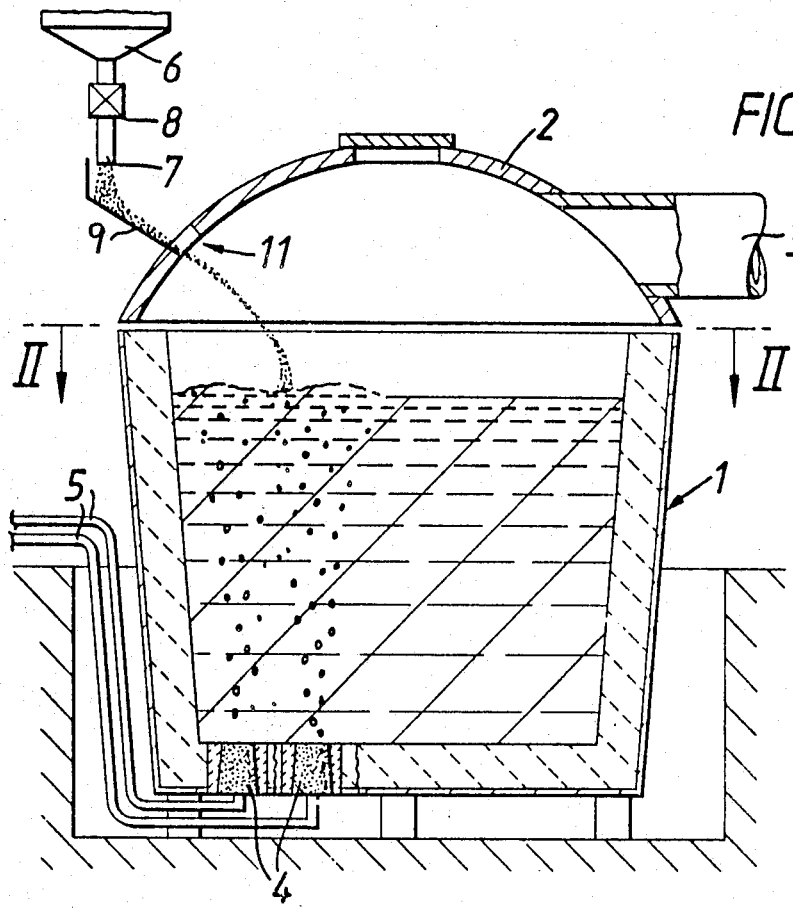
Figure 2:
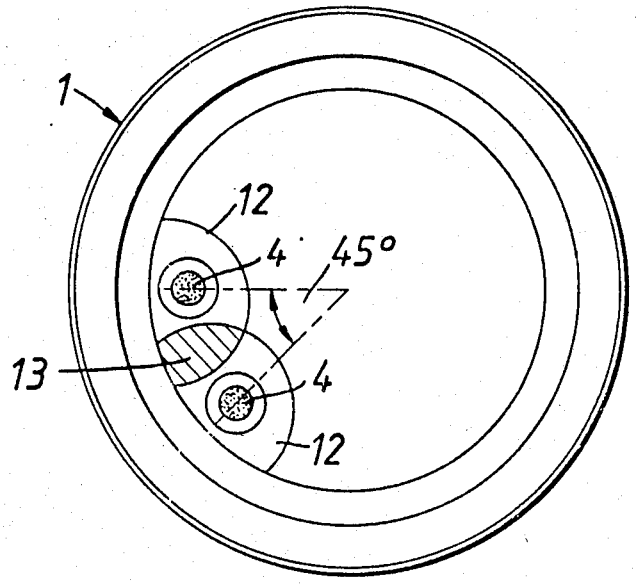

The apparatus illustrated in FIGS. 1 and 2 includes a refractory lined ladle 1 and a sealed hood 2 from which extends a fume extraction duct or chamber 3. Two porous refractory plugs 4 are sited in the base of the ladle and are spaced such that imaginary lines drawn between the vertical axes of the plugs and the vertical axis of the ladle define with the ladle bottom and walls a 45° segment. As will be seen from FIG. 2, the plugs 4 are located close to the inner wall of the ladle; in the arrangement illustrated, the axes of the plugs 4 are spaced inwardly of the outer wall of the ladle by a distance equivalent to approximately ¼ to 1/6th of the external ladle diameter. Two independently controlled argon lines 5 feed the plugs 4.

Sited above the hood is a hopper 6 housing lead shot and having a discharge spout 7 controlled through a valve 8 and a downwardly inclined spreader plate 9, positioned to feed the shot through a slot 11 formed in the hood.

In operation, steel from, e.g. an electric arc furnance, superheated to between 1630° C. and 1670° C. is tapped into the ladle 1. At the completion of tap, a sample is taken for analysis and any additions which may be required to enable the melt to achieve the required specification are made.

The argon lines 5 are then opened to enable gas to be injected through the plugs 4 at rates sufficient to attain a back pressure on each plug of about 5 bar. Visual assessment of the resulting turbulence on the surface of the molten metal may reveal the need to adjust one or other gas flow in order to produce on the surface of the melt a relatively quiescent zone 13. This relatively quiescent zone is created by the interaction of areas of turbulence 12 caused by the rising gas currents. As mentioned previously, whereas some disturbance will inevitably occur in the surface zone 13, it will be considerably less than the turbulence occurring in the zones 12.

Once the relatively quiescent zone has been established, the hood 2 is fitted and the hopper valve 8 opened for the discharge of shot (typically 0.5 to 1.0 mm in diameter) onto the surface of the molten metal via the distribution plate 9.

With a ladle capacity of, say, 170 tonnes, the rate of discharge may be of the order of 50 kg per minute and the treatment time may vary between 7 minutes and 14 minutes depending on the composition required.

Gas injection is arrested on completion of the lead addition by turning off the argon lines and a sample of the metal taken for analysis. Gas injection may be restarted if any lead trimming or alloying is found to be necessary following analysis of the sample. Once the required specification has been achieved, the extraction hood 3 is removed and the ladle 1 is ready for teeming into ingots or a continuous casting machine.

Almost any steel quality may be leaded in this fashion and, of course, other elements such as bismuth, tellurium may alternatively, or additionally, be added. Amongst melts treated in accordance with the treatment technique described are low carbon free-cutting steels having a composition by weight % of, e.g.

| C | Si | Mn | P | S | Pb |
|---|---|---|---|---|---|
| 0.10 max | 0.30 max | 0.80/1.50 | 0.09 max | 0.25/0.40 | 0.15/0.35 |

balance iron and incidental impurities; typical re-sulphurised machining steels which can be similarly treated include

| | |
|---|---|
| | SAE 11L17 |
| | SAE 12L14 |
| German Werkstoff number | 9 SMnPb28 |
| German Werkstoff number | 9 SMnPb36 |
| | SIS 141914 |
| | SIS 141926 |
| Afnor | S 250Pb |
| Afnor | S 300Pb |

Fine and coarse grain leaded carbon steels, can also be treated, for example BS 970, 080 M 40 P6. Other steels treated in accordance with the invention include alloy leaded steels, e.g. BS 970; 817 M 40; 709 M 40 or SAE 8620.

Whilst the invention has been described with particular reference to the addition of particulate lead to a steel melt, it is to be understood that the invention is not limited to such and that other alloying components or reagents may be added to melts other than steel using the apparatus and method described above.

Further, although the invention has been described with reference to the particular embodiment illustrated it is to be understood that various modifications may readily be introduced without departing from the scope of this invention. For example, the positioning of the plugs or nozzles may be different from that shown consistent with the necessity for producing a relatively quiescent zone or region on the surface of the molten metal. Further, more than two plugs or nozzles may be used and may be spaced a greater distance away from the wall than as illustrated in FIG. 2. Indeed, the plugs may be located in the side of a ladle or in both the side and the base of the ladle. The manner in which the lead is fed into the melt may also be changed consistent with the achievement of even and regular feeding. To achieve better 'area' distribution more than one slotted opening may be provided in the hood for the addition of particulate additions. Distribution from the or each spreader plate may be assisted by a pressure feed such as a pulsed air line. The lead may be added over an extended period, particularly if ladle re-heating facilities are available for use during or after the lead addition period. Further, the addition may be encapsulated in a consumable (eg mild steel) sheath or may take the form of a wire or strip. In such cases, the rate at which the sheath, wire or strip is fed into the relatively quiescent zone is sufficiently low as to effect release of the alloying or reagent content onto the surface of the molten metal resident in the quiescent zone.

Reference has been made to a refractory lined ladle; the lining may, for example, comprise a basic refractory lining, a mid-alumina lining or a fireclay lining.

We claim:

1. A method of introducing into a bath of molten metal contained in a vessel an additional constituent, which method comprises the steps of connecting a plurality of gas flow passageways located in at least one of bottom and side walls of the vessel to supplies of gas under pressure, causing gas under pressure to be introduced simultaneously through the passageways to produce individual gas flows which pass upwardly through the metal bath to create areas of turbulence the boundaries of which interact partially to produce on the surface of the metal bath a relatively quiescent region with respect to immediately adjacent regions, and introducing into this relatively quiescent region a required quantity of the additional constituent.

2. A method as claimed in claim 1 in which the molten metal is pre-heated to a temperature in excess of that required for discharge of the metal from the vessel to promote solubility of the introduced additional constituent.

3. A method as claimed in claim 2 wherein the molten metal is steel pre-heated to a temperature of between 1630° C. and 1670° C.

4. A method as claimed in claim 1 including the additional step of independently controlling the flow of gas to each passageway to govern a degree of interaction between the respective areas of turbulence.

5. A method as claimed in claim 1 in which the additional constituent is lead in particulate form.

6. A method as claimed in claim 5 wherein the particulate lead is discharged under gravity onto the bath surface.

7. A method of introducing into a bath of molten metal contained in a vessel an additional constituent in which the addition is made into a quiescent region created on the surface of the metal bath by the interaction of turbulent regions produced by upward flows through the molten metal of gas introduced into the vessel through a plurality of spaced passageways located in at least one of bottom and side walls of the vessel.

* * * * *